US011480393B2

(12) United States Patent
Skoglösa et al.

(10) Patent No.: US 11,480,393 B2
(45) Date of Patent: Oct. 25, 2022

(54) HEAT EXCHANGER PLATE, A PLATE PACKAGE USING SUCH HEAT EXCHANGER PLATE AND A HEAT EXCHANGER USING SUCH HEAT EXCHANGER PLATE

(71) Applicant: ALFA LAVAL CORPORATE AB, Lund (SE)

(72) Inventors: Anders Skoglösa, Ramlösa (SE); Per Sjödin, Lund (SE)

(73) Assignee: ALFA LAVAL CORPORATE AB, Lund (SE)

( * ) Notice: Subject to any disclaimer, the term of this patent is extended or adjusted under 35 U.S.C. 154(b) by 312 days.

(21) Appl. No.: 16/476,185

(22) PCT Filed: Feb. 15, 2018

(86) PCT No.: PCT/EP2018/053751
§ 371 (c)(1),
(2) Date: Jul. 5, 2019

(87) PCT Pub. No.: WO2018/162200
PCT Pub. Date: Sep. 13, 2018

(65) Prior Publication Data

US 2020/0025453 A1 Jan. 23, 2020

(30) Foreign Application Priority Data

Mar. 10, 2017 (EP) ..... 17160259

(51) Int. Cl.
*F28D 9/00* (2006.01)
*F28D 21/00* (2006.01)

(52) U.S. Cl.
CPC ..... *F28D 9/0006* (2013.01); *F28D 9/0037* (2013.01); *F28D 9/0043* (2013.01);
(Continued)

(58) Field of Classification Search
CPC .... F28D 9/0006; F28D 9/0031; F28D 9/0037; F28D 9/0043; F28D 9/0056; F28D 9/0062; F28D 2021/0089; F28D 2021/0064
See application file for complete search history.

(56) References Cited

U.S. PATENT DOCUMENTS 4,229,868 A * 10/1980 Kretzinger ..... F28D 9/0043 165/166
4,291,752 A * 9/1981 Bridgnell ..... F28F 9/005 165/81

(Continued)

FOREIGN PATENT DOCUMENTS

CN 1204393 A 1/1999
CN 1842689 A 10/2006

(Continued)

OTHER PUBLICATIONS

International Search Report for PCT/EP2018/053751 (PCT/ISA/210) dated May 22, 2018.

(Continued)

*Primary Examiner* — Jianying C Atkisson
*Assistant Examiner* — For K Ling
(74) *Attorney, Agent, or Firm* — Birch Stewart, Kolasch & Birch, LLP

(57) ABSTRACT

A heat exchanger plate for use in a plate package for a heat exchanger device is disclosed. The plate has a geometrical main extension plane (q) and a circumferential edge portion, the circumferential edge portion having a curved upper portion, a substantially straight lower portion and two opposing side portions interconnecting the upper and the lower portions. An upper porthole is arranged in an upper section of the heat exchanger plate and located at a distance from the upper portion of the circumferential edge portion thereby defining an upper intermediate portion. The upper (Continued)

intermediate portion includes the shortest distance (d2) between a centre of the upper porthole and the upper portion of the circumferential edge portion. The heat exchanger plate further comprises an upper flange having an extension along the upper portion of the circumferential edge portion. The upper flange has a length (L2) as seen in a direction transverse the shortest distance (d2), being 200-80% of the diameter (D2) of the upper porthole and more preferred 180-120% of the diameter (D2) of the upper porthole. Further, a plate package is disclosed and also a heat exchanger device using such heat exchanger plate/plate package.

20 Claims, 6 Drawing Sheets

(52) U.S. Cl.
CPC .. *F28D 21/0017* (2013.01); *F28D 2021/0064* (2013.01); *F28F 2280/04* (2013.01)

(56) References Cited

U.S. PATENT DOCUMENTS

| | | | | | |
|---|---|---|---|---|---|
| 4,310,960 | A * | 1/1982 | Parker | B23P 15/26 | 165/166 |
| 6,918,433 | B2 * | 7/2005 | Kontu | F28D 9/0043 | 165/145 |
| 7,004,237 | B2 * | 2/2006 | Mathur | F28D 9/0006 | 165/167 |
| 7,472,563 | B2 * | 1/2009 | Knoll | F25B 39/022 | 62/515 |
| 7,594,538 | B2 * | 9/2009 | Stenhede | F28F 3/04 | 165/145 |
| 8,028,410 | B2 * | 10/2011 | Thompson | F28D 21/001 | 29/890.039 |
| 2005/0230092 | A1 * | 10/2005 | Emrich | F28D 9/0043 | 165/167 |
| 2006/0191672 | A1 | 8/2006 | Stenhede | | |
| 2008/0041096 | A1 * | 2/2008 | Sakashita | F28D 9/0006 | 62/515 |
| 2011/0011568 | A1 | 1/2011 | Han et al. | | |
| 2011/0120672 | A1 | 5/2011 | Ringwaldt | | |
| 2014/0216700 | A1 | 8/2014 | Odillard et al. | | |
| 2018/0128549 | A1 | 5/2018 | Takeda et al. | | |

FOREIGN PATENT DOCUMENTS

| | | | | | |
|---|---|---|---|---|---|
| CN | 101595361 | A | | 12/2009 | |
| CN | 201819584 | U | | 5/2011 | |
| CN | 103890525 | A | | 6/2014 | |
| CN | 101970907 | B | | 1/2015 | |
| CN | 205561602 | U | | 9/2016 | |
| DE | 10 2006 025 536 | A1 | | 12/2007 | |
| DE | 10 2013 227 094 | A1 | | 6/2015 | |
| EP | 0857287 | B1 | | 2/2003 | |
| EP | 1634031 | B1 | | 3/2010 | |
| EP | 2295834 | B1 | | 1/2013 | |
| EP | 2084481 | B1 | | 1/2016 | |
| JP | 2000283661 | A | * | 10/2000 | F28D 9/0043 |
| JP | 2000304487 | A | * | 11/2000 | F28D 9/0043 |
| JP | 2001-280888 | A | | 10/2001 | |
| JP | 2006-527835 | A | | 12/2006 | |
| JP | 2016-148491 | A | | 8/2016 | |
| JP | 2017-3175 | A | | 1/2017 | |
| WO | WO 03/093749 | A1 | | 11/2003 | |
| WO | WO 2004/111564 | A1 | | 12/2004 | |
| WO | WO 2008/063121 | A1 | | 5/2008 | |
| WO | WO 2013/144251 | A1 | | 10/2013 | |

OTHER PUBLICATIONS

Written Opinion of the International Searching Authority for PCT/EP2018/053751 (PCT/ISA/237) dated May 22, 2018.
English translation of the Korean Office Action, dated Sep. 28, 2020, for Korean Application No. 10-2019-7029216.
English Translation of the Japanese Office Action for Japanese Application No. 2019-543845, dated Oct. 19, 2020.

* cited by examiner

HEAT EXCHANGER PLATE, A PLATE PACKAGE USING SUCH HEAT EXCHANGER PLATE AND A HEAT EXCHANGER USING SUCH HEAT EXCHANGER PLATE

FIELD OF INVENTION

The invention relates to a heat exchanger plate, a plate package using such heat exchanger plate, the use of a heat exchanger plate of such type in a heat exchanger device and also a heat exchanger device as such.

TECHNICAL BACKGROUND

A typical plate package to be used in a plate heat exchanger device comprises a plurality of heat exchanger plates, alternatingly arranged one on top of the other together with an intermediate bonding material. Each heat exchanger plate is typically provided with a complex pattern of ridges and valleys to thereby form a pattern of flow channels in the resulting plate interspaces between adjacent heat exchanger plates. The resulting stack is arranged in an oven where the heat exchanger plates are subjected to heat and thereby are bonded to each other along their contact surfaces. As a result, a plate package is provided.

To allow a fluid flow through the plate interspaces of the plate package, each heat exchanger plate is provided with an inlet porthole and an outlet porthole. The portholes are typically arranged in the proximity of a circumferential edge of the heat exchanger plate. The proximity to a circumferential edge is advantageous since the available heat transferring surface in the plate package thereby is affected to a low extent. Also, it is a well-known truth that it is difficult to distribute the fluid into the intermediate area between the porthole and the circumferential edge whereby the efficiency provided by the intermediate area typically is lower as compared to the remainder of the area of the heat exchanger plate. It is also a matter of reducing material consumption and thereby cost and weight of the plate package.

Still, the proximity must not be too small since that also induces an overall weakness to the heat exchanger plate and the plate package. A reduced weakness becomes obvious when handling the individual heat exchanger plates during stacking since the plates may be experienced as being flabby. This is especially the case of larger heat exchanger plates.

The proximity may also cause quality problems to the plate package during manufacturing. If a porthole is arranged too close to the circumferential edge, the heat transfer across the main extension plane during the step of bonding the stacked heat exchanger plates in an oven becomes uneven. This results in buckling which is due to an uneven thermal expansion across the surface of the heat exchanger plates and especially in the intermediate area that is formed between the circumferential edge of the heat exchanger plate and the porthole as compared to the overall area of the heat exchanger plate. Buckling causes the risk of insufficient bonding along the intended contact surfaces between adjacent heat exchanger plates. Insufficient bonding may cause leakage of fluid between the intended flow channels that are to be formed by bonding between two adjacent heat exchanger plates. Insufficient bonding may also cause leakage of fluid to the ambience along the perimeter of the plate package. The latter is a non-acceptable defect.

Accordingly, the positioning of the portholes requires a lot of considerations.

SUMMARY OF INVENTION

It is an object of the invention to provide a heat exchanger plate in which the portholes may be arranged in the proximity to a circumferential edge portion of the heat exchanger plate while at the same time allowing an even heat distribution during bonding and thereby an improved joint quality.

It is also an object of the invention to provide an overall stiffer heat exchanger plate, which as such facilitates handling and stacking of the heat exchanger plate.

As yet another object, a heat exchanger plate should be provided which is allows more simple fixtures to be used during stacking of the heat exchanger plates.

These objects are met by a heat exchanger plate for use in a plate package for a heat exchanger device, the heat exchanger plate having a geometrical main extension plane and a circumferential edge portion, the circumferential edge portion having a curved upper portion, a substantially straight lower portion and two opposing side portions interconnecting the upper and the lower portions, and an upper porthole arranged in an upper section of the heat exchanger plate and located at a distance from the upper portion of the circumferential edge portion thereby defining an upper intermediate portion located between the upper portion of the circumferential edge portion and a circumferential edge of the upper porthole, the upper intermediate portion including the shortest distance between a centre of the upper porthole and the upper portion of the circumferential edge portion, wherein the heat exchanger plate, along at least a section of the upper intermediate portion, further comprises an upper flange having an extension along the upper portion of the circumferential edge portion and extending from the circumferential edge portion in direction from the geometrical main extension plane, wherein the upper flange has a length as seen in a direction transverse the shortest distance, being 200-80% of the diameter of the upper porthole and more preferred 180-120% of the diameter of the upper porthole.

When subjecting the heat exchanger plate to heat during bonding of a stack of heat exchanger plates in an oven, the heat will transfer from the periphery of the heat exchanger plate towards the centre thereof. The time to achieve an even temperature gradient across the heat exchanger plate will depend on the amount of material that must be heated. In a prior art heat exchanger plate without a flange, the intermediate portion will be heated faster than the remainder of the heat exchanger plate. Such uneven temperature gradient in combination with the fact that the intermediate portion is weaker than the remainder of the heat exchanger plate results in the risk of a thermal buckling of the intermediate portion. The buckling jeopardizes the intended contact surfaces between adjacent heat exchanger plates, which in turn results in insufficient bonding and leaking joints. In the worst case scenario, the resulting plate package will leak fluid to the medium, which is a non-acceptable defect.

The invention resides in the idea of arranging a flange along at least an extension of the intermediate portion in the proximity to the porthole. Thereby a heat shielding effect is provided for. The heat shielding effect is caused by the locally added material that must be heated prior to the intermediate portion. By providing the locally added material as a flange, the added material will not form part of the available heat transferring area/foot print of the heat exchanger plate but rather extend along the circumferential side walls of the plate package to be formed. Accordingly, a more even temperature gradient may be provided. The improved heat distribution allows for an overall higher joint quality and thereby a lower risk of leakage.

The flange will not only act as a heat shield, but also provide the heat exchanger plate with an overall improved stiffness that makes the heat exchanger plate less flabby during handling. The latter is especially the case for larger heat exchanger plates. Further, the flange will contribute to the guiding of heat exchanger plates during stacking and handling of the stack until bonding. Thereby fixtures can be made less complex.

The extension of the flange depends on parameters such as the curvature of the portion of the circumferential edge portion along which the porthole is arranged, the shortest distance between the center of the porthole and the circumferential edge, the diameter of the porthole and the thickness of the material of the heat exchanger plate.

In the present case the upper porthole is arranged in the upper section of the heat exchanger plate and located at a distance from the upper curved edge portion. The curved edge results in that the area of the intermediate portion is smaller than if the upper portion instead should be straight. Simulations and trials have shown that provided the upper edge portion is curved, the flange may have a length, that as seen in a direction transverse the shortest distance between the upper portion of the circumferential edge portion and the centre of the upper porthole, is 200-80% of the diameter of the upper porthole and more preferred 180-120% of the diameter of the upper porthole.

As an alternative or a supplement to the formulation that the upper flange extends from the circumferential edge portion in direction from the geometrical main extension plane, the upper flange may extend from the circumferential edge portion at an angle $\alpha$ to the normal of the geometrical main extension plane.

The heat exchanger plate may further comprise a lower porthole arranged in a lower section of the heat exchanger plate and located at a distance from the lower portion of the circumferential edge portion thereby defining a lower intermediate portion located between the lower portion of the circumferential edge portion and a circumferential edge of the lower porthole, the lower intermediate portion including the shortest distance between a centre of the lower porthole and the lower portion of the circumferential edge portion, wherein the heat exchanger plate, along at least a section of the lower intermediate portion, further comprises a lower flange having an extension along the lower portion of the circumferential edge portion and extending from the circumferential edge portion in direction from the geometrical main extension plane, wherein the lower flange has a length as seen in a direction transverse the shortest distance, being smaller than the diameter of the lower porthole and more preferred smaller than 80% of the diameter of the lower porthole.

The lower flange serves the same purpose as the upper flange discussed above and to avoid undue repetition reference is made to the above. As a difference to the upper intermediate portion discussed above, the lower intermediate portion is arranged between the straight lower portion of the circumferential edge portion and the lower porthole. Provided the shortest distances in the two situations are the same and also the diameters of the lower and upper portholes are the same, the area of the upper intermediate portion will be smaller than the lower intermediate portion. To allow a corresponding heat shielding effect, the upper flange should thus be made longer than the lower flange. Simulations and trials have shown that the lower flange may have a length as seen in a direction transverse the shortest distance, that is being smaller than the diameter of the lower porthole and more preferred smaller than 80% of the diameter of the lower porthole.

As an alternative or a supplement to the formulation that the lower flange extends from the circumferential edge portion in direction from the geometrical main extension plane, the lower flange may extend from the circumferential edge portion at an angle $\alpha$ to the normal of the geometrical main extension plane.

The lower and/or upper flanges may have an extension with a component along a normal to the main extension plane of the heat exchanger plate, and wherein the angle $\alpha$ formed by the lower and/or upper flanges to the geometrical main extension plane is smaller than 20 degrees to the normal. The angle $\alpha$ depends on if both of the two subsequent heat exchanger plates of a plate pair to be joined are provided with flanges or if only one of the heat exchanger plates have a flange. In case of only one of the plates having a flange, the angle $\alpha$ can be made smaller, such as smaller than 10 degrees.

According to another aspect, the invention refers to a plate package comprising a plurality of heat exchanger plates of a first type and a plurality of heat exchanger plates of a second type arranged alternatingly in the plate package one on top of the other, wherein at least the heat exchanger plates of the first type correspond to the heat exchanger plate as previously described.

Reference is made to the previous discussion with the essence that the provision of flanges having a local and limited longitudinal extension along the intermediate portions that are formed between the portholes and the upper and lower portions of the circumferential edge portions, a heat shielding effect is provided for during the manufacturing of the plate package. This allows for a more even temperature gradient. The resulting improved heat distribution allows for an overall higher joint quality and thereby a lower risk of leakage.

The heat exchanger plates of the first type may be identical with the heat exchanger plates of the second type, or alternatively, the heat exchanger plates of the first type may be identical with the heat exchanger plates of the second type, with the exception that the lower and/or the upper flanges are cut-off. Thereby one and the same press-tool can be used.

The flanges of the heat exchanger plates of the first type may be oriented in one and the same direction, and have an extension with a component along a normal to the main extension plane such that a flange of a heat exchanger plate of the first type abuts or overlaps a flange of a second subsequent heat exchanger plate of the first type.

From a heat shielding aspect, the overlap provides for a facilitated and enhanced heat distribution across the edge of the plate package during the bonding operation. This due to the locally added material (twice the material thickness). Also, an overall improved stiffening of the heat exchanger plates is provided which reduces the risk of buckling in the intermediate portions during the heat treatment. The reduced risk of buckling reduces the risk of insufficient bonding along the contact surfaces between adjacent heat exchanger plates and thereby leakage. Further, the overlap provides for a guiding effect during stacking of the heat exchanger plates, thereby reducing the requirements put on fixtures.

The flanges of the heat exchanger plates may be oriented in one and the same direction, and have an extension with a component along a normal to the main extension plane such that a flange of a first heat exchanger plate of the first type abuts or overlaps a flange of a subsequent heat exchanger plate, said subsequent heat exchanger plate being a heat exchanger plate of the second type.

The overlap between two subsequent flanges may form a sealed joint. Thus, it is preferred that a bonding material is arranged not only between the intended contact and bonding points across the heat transferring surfaces of the heat exchanger plates but also along the flanges during stacking of the heat exchanger plates.

The alternatingly arranged heat exchanger plates may form first plate interspaces which are substantially open and arranged to permit a flow of a medium to be evaporated there through, and second plate interspaces, which are closed and arranged to permit a flow of a fluid for evaporating the medium, wherein the heat exchanger plates of the first type and of the second type further comprise, along at least a section of the opposing side portions, mating abutment portions extending along and at a distance from the circumferential edge portion, thereby separating the respective first plate interspaces into an inner heat transferring portion and two outer draining portions, wherein at least the heat exchanger plates of the first type further comprise, along at least a section of the opposing side portions, a draining channel flange extending from the circumferential edge portion in direction from the geometrical main extension plane, wherein the draining channel flanges of the respective heat exchanger plates are oriented in one and the same direction, and have an extension with a component along a normal to the main extension plane such that a draining channel flange of a first heat exchanger plate of the first type abuts or overlaps a draining channel flange of a subsequent heat exchanger plate, said subsequent heat exchanger plate being either a heat exchanger plate of the first type or a heat exchanger plate of the second type, whereby the draining channel flanges form outer walls to the outer draining portions thereby transforming the outer draining portions into draining channels.

As an alternative or a supplement to the formulation that the draining channel flange extends from the circumferential edge portion in direction from the geometrical main extension plane, the draining channel flange may extend from the circumferential edge portion at an angle $\beta$ to the normal of the geometrical main extension plane.

Heat exchanger devices are well known for evaporating various types of cooling medium such as ammonia in applications for generating e.g. cold. The evaporated medium is conveyed from the heat exchanger device to a compressor and the compressed gaseous medium is thereafter condensed in a condenser. Thereafter the medium is permitted to expand and is recirculated to the heat exchanger device. One example of such heat exchanger device is a heat exchanger of the plate-and-shell type, see e.g. WO2004/111564 which discloses a plate package composed of substantially half-circular heat exchanger plates. The use of half-circular heat exchanger plates is advantageous since it provides a large volume inside the shell in the area above the plate package, which volume improves separation of liquid and gas. The separated liquid is transferred from the upper part of the inner space to a collection space in the lower part of the inner space via an interspace. The interspace is formed between the inner wall of the shell and the outer wall of the plate package. The interspace is part of a thermo-syphon loop which sucks the liquid towards the collection space of the shell.

Accordingly, by a plate package design of the above type, cooling medium in liquid form that is present in the upper part of the shell may be guided inside and along a plurality of draining channels that extend along opposing side portions of the inner wall of the shell but at a distance therefrom, and also at a distance from the first plate interspaces that are formed between opposing major surfaces of the heat exchanger plates. The distance is provided, depending on the design of the walls and the joints respectively defining the cross section of the draining channel, by at least the material thickness of the sheet material making up the heat exchanger plates. The distance formed can be seen as an insulation which reduces heat transfer from the inner wall of the shell and from the plate interspaces in the plate package towards the draining channel and which thereby reduces the risk of the liquid medium evaporating inside the draining channel and thereby disturbance or stopping of the thermo-syphon loop. Thereby a more stable liquid flow is promoted.

Also, the draining channels prevents compressor oil, which typically, due to its stronger affinity to carbon steel than stainless steel, is prone to follow the curvature of the inner wall of the shell, from transferring into the first interspaces of the plate package. By the presence of the draining channels, compressor oil that is present inside the interspace between the inner wall of the shell and the outer boundary of the plate package is prevented, from transferring in a direction transverse the longitudinal extension of the draining channel and into the first plate interspaces. Instead, the inflow of compressor oil into the first plate interspaces is now restricted to the longitudinal gaps facing the upper portion of the shell and which forms openings towards to the first interspaces.

By reducing the amount of compressor oil that will come into contact with the first plate interspaces, the risk of formation of thermally insulating deposits on the heat transferring surfaces is reduced. This allows the plate package to be made smaller in terms of foot print or in terms of the number of heat exchanger plates included in the plate package while remaining the efficiency. Thereby the overall cost may be reduced.

According to a further aspect, the invention relates to the use of the heat exchanger plate with the features given above in a heat exchanger device. Advantages of the inventive heat exchanger plate as such have been discussed above, and to avoid undue repetition, reference is made to the sections given above.

According to another aspect, the invention refers to a heat exchanger device including a shell which forms a substantially closed inner space and which includes an inner wall surface facing the inner space, said heat exchanger device being arranged to include a plate package comprising a plurality of heat exchanger plates of the type discussed above. Advantages of the inventive heat exchanger plate as such have been discussed above, and to avoid undue repetition, reference is made to the sections given above.

According to another aspect, the invention refers to a heat exchanger device including a shell which forms a substantially closed inner space and which includes an inner wall surface facing the inner space, said heat exchanger device being arranged to include a plate package of the type discussed above. Advantages of the inventive heat exchanger plate as such have been discussed above, and to avoid undue repetition, reference is made to the sections given above.

According to yet another aspect, the invention refers to a heat exchanger device including a shell which forms a substantially closed inner space and which includes an inner wall surface facing the inner space, said heat exchanger device being arranged to include a plate package, said plate package including a plurality of heat exchanger plates of a first type and a plurality of heat exchanger plates of a second type arranged alternatingly in the plate package one on top of the other, wherein each heat exchanger plate has a geometrical main extension plane and is provided in such a way that the main extension plane is substantially vertical, wherein the alternatingly arranged heat exchanger plates form first plate interspaces which are substantially open towards the inner space and arranged to permit circulation of a medium to be evaporated from a lower part of the inner space upwardly to an upper part of the inner space, and second plate interspaces which are closed to the inner space and arranged to permit flow of a fluid for evaporating the medium, wherein each of the heat exchanger plates of the first type and of the second type has a circumferential edge portion, the circumferential edge portion having a curved upper portion, a substantially straight lower portion and two opposing side portions interconnecting the upper and the lower portions, wherein each of the heat exchanger plates of the first type and of the second type has an upper porthole arranged in an upper section of the heat exchanger plate and located at a distance from the upper portion of the circumferential edge portion thereby defining an upper intermediate portion located between the upper portion of the circumferential edge portion and a circumferential edge of the upper porthole, the upper intermediate portion including the shortest distance between a centre of the upper porthole and the upper portion of the circumferential edge portion, wherein the heat exchanger plate, along at least a section of the upper intermediate portion, further comprises an upper flange having an extension along the upper portion of the circumferential edge portion and extending from the circumferential edge portion in direction from the geometrical main extension plane, wherein the upper flange has a length as seen in a direction transverse the shortest distance, being 200-80% of the diameter of the upper porthole and more preferred 180-120% of the diameter of the upper porthole, wherein each of the heat exchanger plates of the first type and of the second type has a lower porthole arranged in a lower section of the heat exchanger plate and located at a distance from the lower portion of the circumferential edge portion thereby defining a lower intermediate portion located between the lower portion of the circumferential edge portion and a circumferential edge of the lower porthole, the lower intermediate portion including the shortest distance between a centre of the lower porthole and the lower portion of the circumferential edge portion, wherein the heat exchanger plate, along at least a section of the lower intermediate portion, further comprises a lower flange having an extension along the lower portion of the circumferential edge portion and extending from the circumferential edge portion indirection from the geometrical main extension plane, wherein the lower flange has a length as seen in a direction transverse the shortest distance being smaller than the diameter of the lower porthole and more preferred smaller than 80% of the diameter of the lower porthole, and wherein the lower and the upper flanges of the respective heat exchanger plates are oriented in one and the same direction, and have an extension with a component along a normal to the main extension plane such that a flange of a first heat exchanger plate of the first type abuts or overlaps a flange of a subsequent heat exchanger plate, said subsequent heat exchanger plate being either a heat exchanger plate of the first type or a heat exchanger plate of the second type.

Advantages of the inventive heat exchanger plate and the inventive plate package as such have been discussed above, and to avoid undue repetition, reference is made to the sections given above.

At least the heat exchanger plates of the first type may further comprise, along at least a section of the opposing side portions, a draining channel flange extending from the circumferential edge portion in direction from the geometrical main extension plane, wherein the draining channel flanges of the respective heat exchanger plates are oriented in one and the same direction, and have an extension with a component along a normal to the main extension plane such that a draining channel flange of a first heat exchanger plate of the first type abuts or overlaps a draining channel flange of a subsequent heat exchanger plate, said subsequent heat exchanger plate being either a heat exchanger plate of the first type or a heat exchanger plate of the second type, whereby the draining channel flanges form outer walls to the outer draining portions thereby transforming the outer draining portions into draining channels.

Preferred embodiments appear in the dependent claims and in the description.

BRIEF DESCRIPTION OF THE DRAWINGS

The invention will now by way of example be described in more detail with reference to the appended schematic drawings, which shows a presently preferred embodiment of the invention.

DETAILED DESCRIPTION OF PREFERRED EMBODIMENTS

Figure 1:
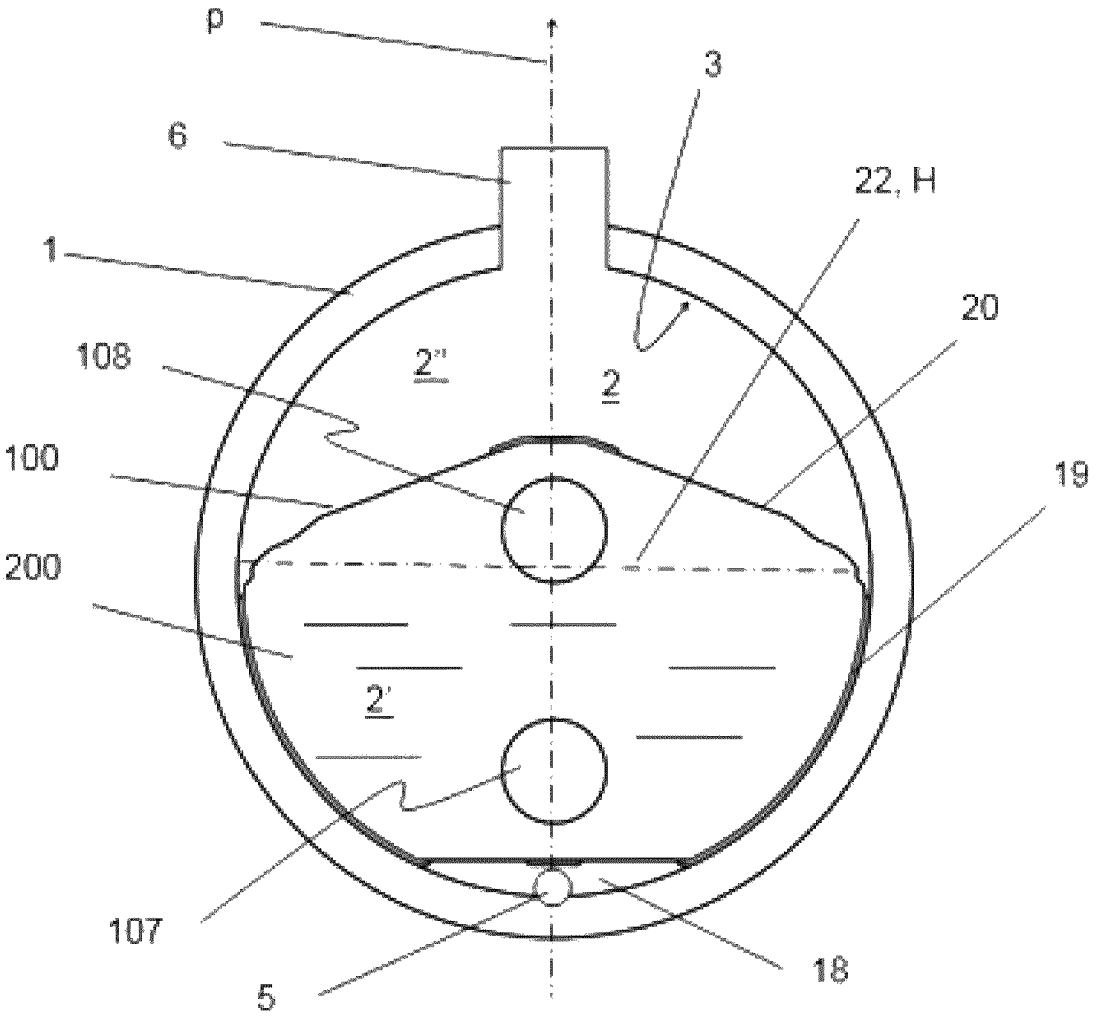
FIG. 1 discloses a schematic and sectional view from the side of a typical heat exchanger device of the plate-and-shell type.
Figure 2:
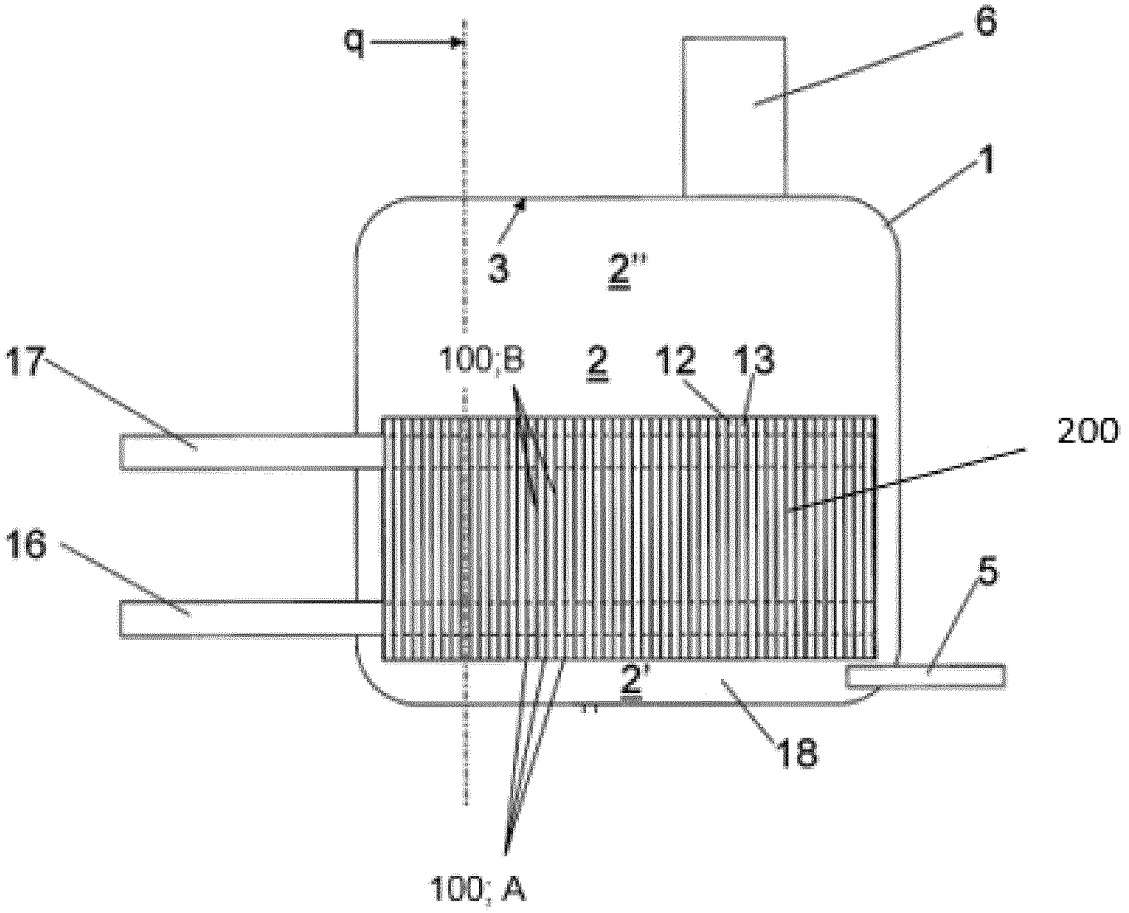
FIG. 2 discloses schematically another sectional view of the heat exchanger device of FIG. 1.

Referring to FIGS. 1 and 2, a schematic cross section of a typical heat exchanger device of the plate-and-shell type is disclosed. The heat exchanger device includes a shell 1, which forms a substantially closed inner space 2. In the embodiment disclosed, the shell 1 has a substantially cylindrical shape with a substantially cylindrical shell wall 3, see FIG. 1, and two substantially plane end walls (as shown in FIG. 2). The end walls may also have a semi-spherical shape, for instance. Also other shapes of the shell 1 are possible. The shell 1 comprises a cylindrical inner wall surface 3 facing the inner space 2. A sectional plane p extends through the shell 1 and the inner space 2. The shell 1 is arranged to be provided in such a way that the sectional plane p is substantially vertical. The shell 1 may by way of example be of carbon steel.

The shell 1 includes an inlet 5 for the supply of a two-phase medium in a liquid state to the inner space 2, and an outlet 6 for the discharge of the medium in a gaseous state from the inner space 2. The inlet 5 includes an inlet conduit which ends in a lower part space 2' of the inner space 2. The outlet 6 includes an outlet conduit, which extends from an upper part space 2" of the inner space 2. In applications for generation of cold, the medium may by way of example be ammonia.

The heat exchanger device includes a plate package 200, which is provided in the inner space 2 and includes a plurality of heat exchanger plates 100 provided adjacent to each other. The heat exchanger plates 100 are discussed in more detail in the following with reference in FIG. 3. The heat exchanger plates 100 are permanently connected to each other in the plate package 200, for instance through welding, brazing such as copper brazing, fusion bonding, or gluing. Welding, brazing and gluing are well-known techniques and fusion bonding can be performed as described in WO 2013/144251 A1. The heat exchanger plates 100 may be made of a metallic material, such as a iron, nickel, titanium, aluminum, copper or cobalt based material, i.e. a metallic material (e.g. alloy) having iron, nickel, titanium, aluminum, copper or cobalt as the main constituent. Iron, nickel, titanium, aluminum, copper or cobalt may be the main constituent and thus be the constituent with the greatest percentage by weight. The metallic material may have a content of iron, nickel, titanium, aluminum, copper or cobalt of at least 30% by weight, such as at least 50% by weight, such as at least 70% by weight. The heat exchanger plates 100 are preferably manufactured in a corrosion resistant material, for instance stainless steel or titanium.

Each heat exchanger plate 100 has a main extension plane q and is provided in such a way in the plate package 200 and in the shell 1 that the extension plane q is substantially vertical and substantially perpendicular to the sectional plane p. The sectional plane p also extends transversally through each heat exchanger plate 100. In the embodiment is disclosed, the sectional plane p also thus forms a vertical centre plane through each individual heat exchanger plate 100.

The heat exchanger plates 100 form in the plate package 200 first interspaces 12, which are open towards inner space 2, and second plate interspaces 13, which are closed towards the inner space 2. The medium mentioned above, which is supplied to the shell 1 via the inlet 5, thus pass into the plate package 200 and into the first plate interspaces 12.

Each heat exchanger plate 100 includes a lower porthole 107 and an upper porthole 108. The lower portholes 107 form an inlet channel connected to an inlet conduit 16. The upper portholes 108 form an outlet channel connected to an outlet conduit 17. It may be noted that in an alternative configuration, the lower portholes 107 form an outlet channel and the upper portholes 108 form an inlet channel. The sectional plane p extends through both the lower portholes 107 and the upper portholes 108. The heat exchanger plates 100 are connected to each other around the portholes 107 and 108 in such a way that the inlet channel and the outlet channel are closed in relation to the first plate interspaces 12 but open in relation to the second plate interspaces 13. A fluid may thus be supplied to the second plate interspaces 13 via the inlet conduit 16 and the associated inlet channel formed by the lower portholes 107, and discharged from the second plate interspaces 13 via the outlet channel formed by the upper portholes 107 and the outlet conduit 17.

As is shown in FIG. 1, the plate package 200 has an upper side and a lower side, and two opposite transverse sides. The plate package 200 is provided in the inner space 2 in such a way that it substantially is located in the lower part space 2' and that a collection space 18 is formed beneath the plate package 200 between the lower side of the plate package and the bottom portion of the inner wall surface 3.

Furthermore, recirculation channels 19 are formed at each side of the plate package 200. These may be formed by gaps between the inner wall surface 3 and the respective transverse side or as internal recirculation channels formed within the plate package 200.

Each heat exchanger plate 100 includes a circumferential edge portion 20 which extends around substantially the whole heat exchanger plate 100 and which permits said permanent connection of the heat exchanger plates 100 to each other. These circumferential edge portions 20 will along the transverse sides abut the inner cylindrical wall surface 3 of the shell 1. The recirculation channels 19 are formed by internal or external gaps extending along the transverse sides between each pair of heat exchanger plates 100. It is also to be noted that the heat exchanger plates 100 are connected to each other in such a way that the first plate interspaces 12 are closed along the transverse sides, i.e. towards the recirculation channels 19 of the inner space 2.

The embodiment of the heat exchanger device disclosed in this application may be used for evaporating a two-phase medium supplied in a liquid state via the inlet 5 and discharged in a gaseous state via the outlet 6. The heat necessary for the evaporation is supplied by the plate package 200, which via the inlet conduit 16 is fed with a fluid for instance water that is circulated through the second plate interspaces 13 and discharged via the outlet conduit 17. The medium, which is evaporated, is thus at least partly present in a liquid state in the inner space 2. The liquid level may extend to the level 22 indicated in FIG. 1. Consequently, substantially the whole lower part space 2' is filled by medium in a liquid state, whereas the upper part space 2" contains the medium in mainly the gaseous state.

Figure 3:
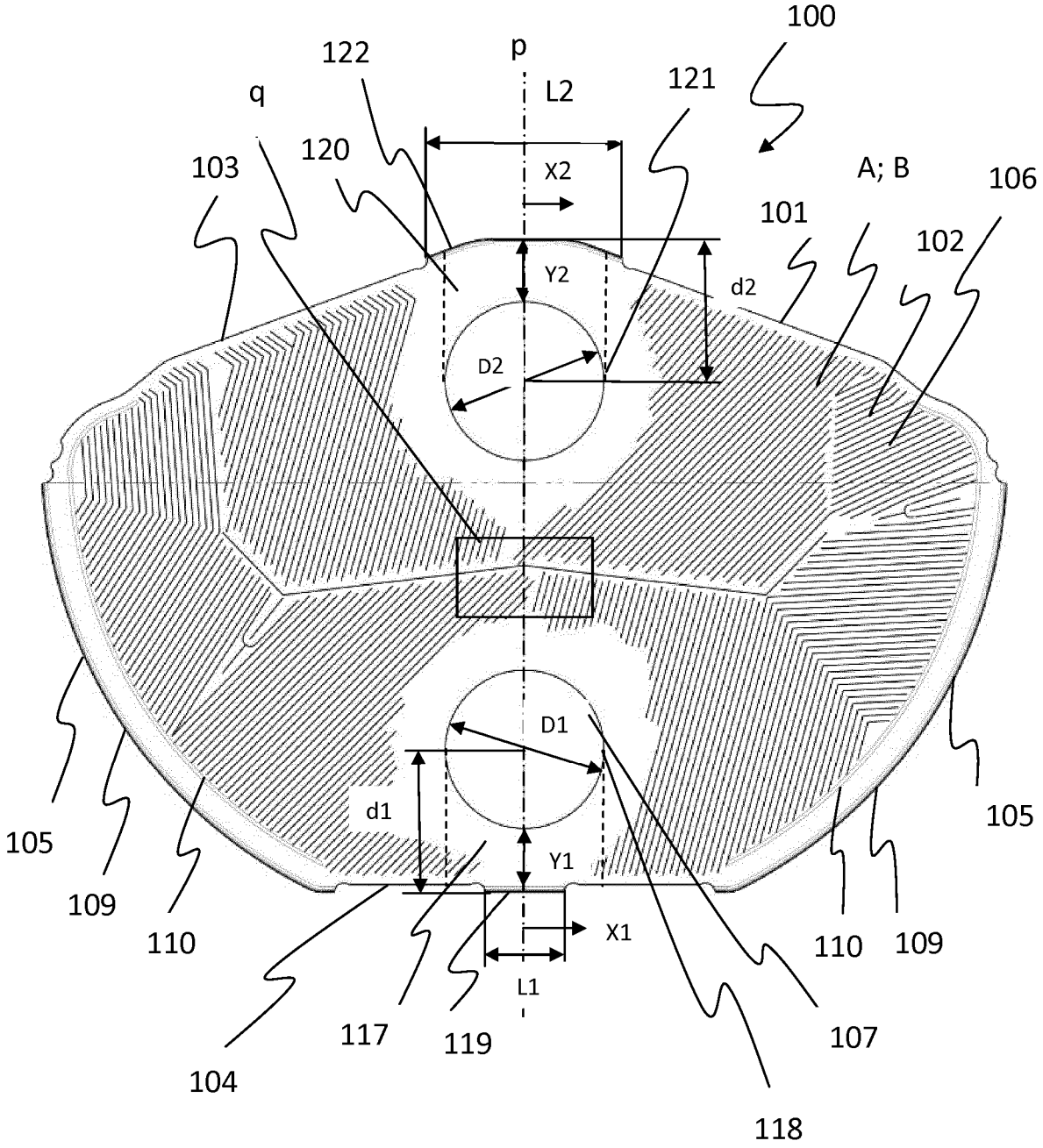
FIG. 3 discloses a heat exchanger plate.

Now turning to FIG. 3, a first embodiment of a heat exchanger plate 100 according to the invention is disclosed. The heat exchanger plate 100 is intended to form part of the plate package according to the invention. The heat exchanger plate 100 may easily be converted into a first type A or a second type B in a manner to be described below.

The heat exchanger plate 100 is provided by a pressed thin walled sheet metal plate. The heat exchanger plate 100 may by way of example be made of stainless steel. The heat exchanger plate 100 has a geometrical main extension plane q and a circumferential edge portion 101. The circumferential edge portion 101 delimits a heat transferring surface 102 extending essentially across the geometrical main plane q.

The circumferential edge portion 101 comprises a curved upper portion 103, a substantially straight lower portion 104 and two opposing side portions 105 interconnecting the upper and the lower portions 103, 104. The two opposing side portions 105 do each have a curvature corresponding to the curvature of the inner wall 3 of the shell 1 of the heat exchanger device 300.

The heat transferring surface 102 comprises a corrugated pattern 106 of ridges and valleys. To facilitate the understanding of the invention the corrugation in and around the upper and lower portholes 107, 108 (to be discussed below) have been removed. The corrugated pattern 106 extends in different directions at different parts of the heat exchanger plate 100. When a plurality of heat exchanger plates 100 are stacked, one on top of the other, to thereby form the plate package 200, every second heat exchanger plate 100 (heat exchanger plate of the first type A) is turned in the manner disclosed in FIG. 3, whereas every other plate (heat exchanger of the second type B) is rotated 180 degrees about a substantially vertical rotary axes coinciding with the sectional plane p. Thereby the corrugations 106 of adjacent heat exchanger plates 100 will cross each other. Also, a plurality of contact points will be formed where the ridges of the adjacent heat exchanger plates 100 abut each other. A layer of bonding material (not disclosed) may be arranged between the heat exchanger plates 100 during stacking. As the stack later is subjected to heat in an oven, the heat exchanger plates 100 will bond to each other along the contact points and thereby form a complex pattern of fluid channels. In such a way, an efficient heat transfer from the fluid to the medium is ensured at the same time as the plates included in the plate package are given the required mechanical support.

The bonding of the heat exchanger plates 100 to provide the plate package 200 may be made by brazing or by fusion bonding as discussed above. Fusion bonding is especially suitable when the heat exchanger plates 100 are made by stainless steel.

Depending on how the heat exchanger plate 100 is oriented in the plate package 200, one side of the heat exchanger plate 100 will, during operation of the plate package 200 in a heat exchanger device 300, face the first plate interspace 12 and hence be in contact with the two-phase medium, whereas the opposite side of the heat exchanger plate 100 will face the second plate interspace 13 and hence be in contact with the fluid.

The heat exchanger plate 100 comprises a lower porthole 107 intended to form an inlet port and an upper porthole 108 intended to form an outlet port. In the disclosed embodiment, the lower porthole 107 is located in the proximity of the lower portion 104 and the upper porthole 108 is located in the proximity of the upper portion 103. When the heat exchanger plate 100 is arranged to form part of a plate package 200, the fluid will hence during operation, flow upwardly through the second plate interspaces 13 in the plate package 200. It is to be understood that it is possible to provide the portholes 107, 108 in other positions on the heat exchanger plate 100.

The lower porthole 107 is arranged in a lower section of the heat exchanger plate 100 and located at a distance from the lower portion 104 of the circumferential edge portion 101. Thereby a lower intermediate portion 117 is defined which is located between the circumferential edge portion 101 and a circumferential edge 118 of the lower porthole 107. The lower intermediate portion 117 includes the shortest distance d1 between a centre of the lower porthole 107 and the lower portion 104 of the circumferential edge portion 101. Also, the lower intermediate portion 117 has a height Y1 along the shortest distance and a width X1 transverse to the shortest distance d1.

A lower flange 119 is arranged to have an extension along the lower portion 104 of the circumferential edge portion 101. The lower flange 119 is arranged to extend along at least a section of the lower intermediate portion 117. The lower flange 119 extends towards the surface of the heat exchanger plate 100 that is intended to be in contact with the fluid, i.e. the surface that is intended to face the second plate interspace 13. The lower flange 119 extends from the circumferential edge portion 101 in direction from the geometrical main extension plane q. The lower flange 109 extends from the circumferential edge portion 101 at an angle $\alpha$ to the normal of the geometrical main extension plane q.

The lower flange 119 has a length L1 as seen in a direction transverse the shortest distance d1, being smaller than the diameter D1 of the lower porthole 107 and more preferred smaller than 80% of the diameter D1 of the lower porthole 107.

The upper porthole 108 is arranged in an upper section of the heat exchanger plate 100 and located at a distance from the upper portion 103 of the circumferential edge portion 101. Thereby an upper intermediate portion 120 is defined which is located between the circumferential edge portion 101 and a circumferential edge 121 of the upper porthole 108. The upper intermediate portion 120 includes the shortest distance d2 between a centre of the upper porthole 108 and the upper portion 103 of the circumferential edge portion 101. Also, the upper intermediate portion 120 has a height Y2 along the shortest distance d2 and a width X2 transverse to the shortest distance d2.

An upper flange 122 is arranged to have an extension along the upper portion 103 of the circumferential edge portion 101. The upper flange 122 is arranged to extend along at least a section of the upper intermediate portion 120. The upper flange 122 extends towards the surface of the heat exchanger plate 100 that is intended to be in contact with the fluid, i.e. the surface that is intended to face the second plate interspace 13. The upper flange 122 extends from the circumferential edge portion 101 in direction from the geometrical main extension plane q. The upper flange 109 extends from the circumferential edge portion 101 at an angle $\alpha$ to the normal of the geometrical main extension plane q.

The upper flange 122 has a length L2 as seen in a direction transverse the shortest distance d2, being 200-80% of the diameter D2 of the upper porthole 108 and more preferred 180-120% of the diameter D2 of the upper porthole 108.

Figure 6:
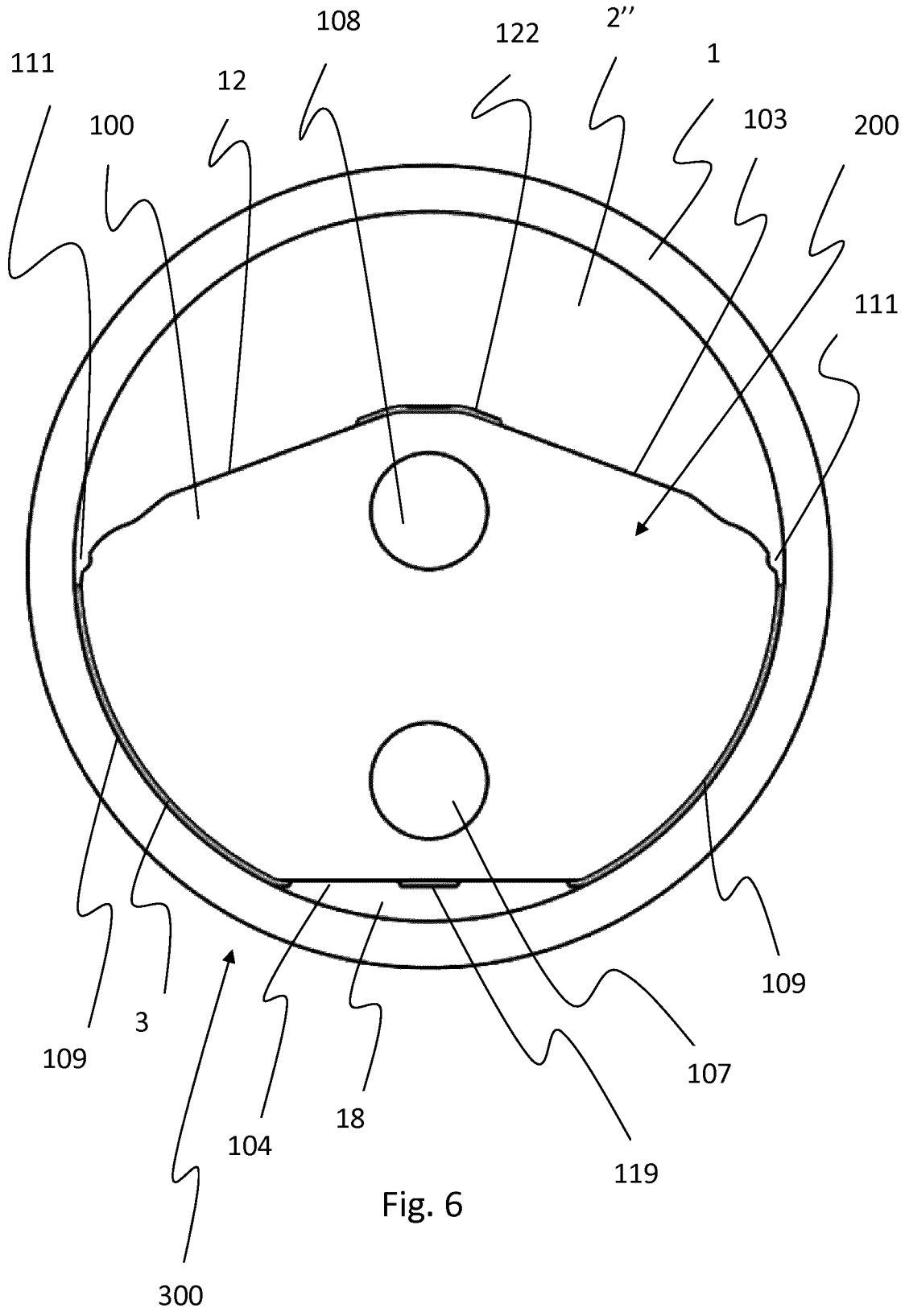
FIG. 6 discloses a schematic cross section of a heat exchanger device.

As is best seen in FIGS. 3 and 6, the curvature of the upper portion 103 of the circumferential edge portion 101 of the heat exchanger plate 100 differs from the curvature of the lower portion 104 of the heat exchanger plate 100. When the heat exchanger plate 100 is included in a plate package 200 and used in a heat exchanger device 300, the lower portion 104 is intended to face the collection space 18 that is formed in the shell 1 beneath the plate package 200. To allow the collection space 18 to have a certain volume, the lower portion 104 is in the disclosed embodiment more or less straight, whereas the upper portion 103 which is intended to face the upper part space 2" of the shell 1 has a convex curvature. Accordingly, the extension of the circumferential edge portion 101 adjacent a porthole 107, 108 affects the area of the available intermediate portion 117, 120.

In the case where the lower portion 104 is essentially straight, the height Y1 of the lower intermediate portion 117 between the lower portion 104 and the circumferential edge 101 of the lower porthole 107 will increase rather rapidly with the distance X1 from the sectional plane p.

This can be compared to the upper porthole 108 adjacent the upper curved portion 103, where the height Y2 of the upper intermediate portion 120 between the curved upper portion 103 and the circumferential edge 101 of the upper porthole 108 will increase more slowly with the distance X2 from the sectional plane p. The decisive factor in this case is the radius of the curved edge portion.

The impact from this difference can be seen by studying the temperature gradient when subjecting a stack of heat exchanger plates 100 to heat in an oven for bonding purposes. The upper intermediate portion 120 with the curved upper portion 103 will heat more rapidly than the lower intermediate portion 117 with the straight edge portion 104.

By introducing the lower and the upper flanges 119, 122 and adjusting their lengths L1, L2 to the diameter D1, D2 of the respective portholes 107, 108, the difference in heating may be compensated for. Thereby the risk of buckling due to uneven thermal expansion and thereby insufficient bonding may be dealt with.

Figure 5:
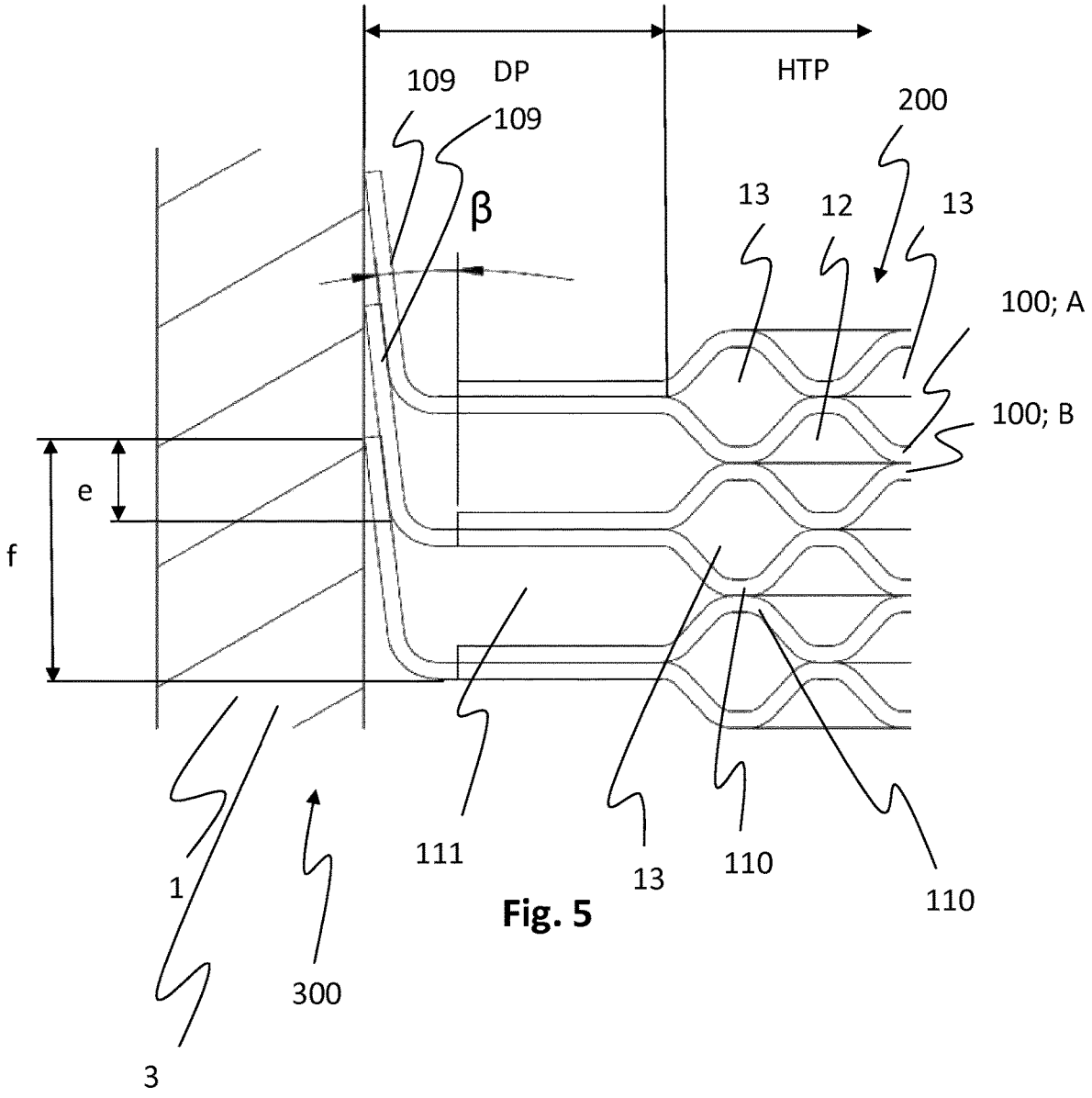
FIG. 5 discloses a cross section of the plate package across a draining flange.

Now turning to FIGS. 3 and 5, the heat exchanger plate 100 may comprise, along at least a section of the opposing side portions 105, a ridge 110 extending along and at a distance from the two opposing side portions 105 of the circumferential edge portion 101. When the heat exchanger plates 100 are stacked, the ridge 110 of a heat exchanger plate 100 of the first type A is arranged to abut the ridge 110 of an adjacent heat exchanger plate 100 of the second type B. Thereby, the respective second plate interspaces 13 are separated into an inner heat transferring portion HTP and two outer draining portions DP. The respective draining portion DP will have an extension along the respective side portion 105 of the heat exchanger plate 100.

The ridges 110 may have an extension that extends past the transition between the upper portion 103 and the respective side portions 105. The ridges 110 may also have an extension that extends past the transition between the respective opposing side portions 105 and the lower portion 104.

The heat exchanger plate 100 further comprises a draining channel flange 109 along at least a section of the two opposing side portions 103. The draining channel flanges 109 extend towards the surface of the heat exchanger plate 100 that is intended to be in contact with the fluid, i.e. the surface that is intended to face the second plate interspace 13. The draining channel flange 109 extends from the circumferential edge portion 101 in direction from the geometrical main extension plane q. The draining channel flange 109 extends from the circumferential edge portion 101 at an angle β to the normal of the geometrical main extension plane q.

Figure 4:
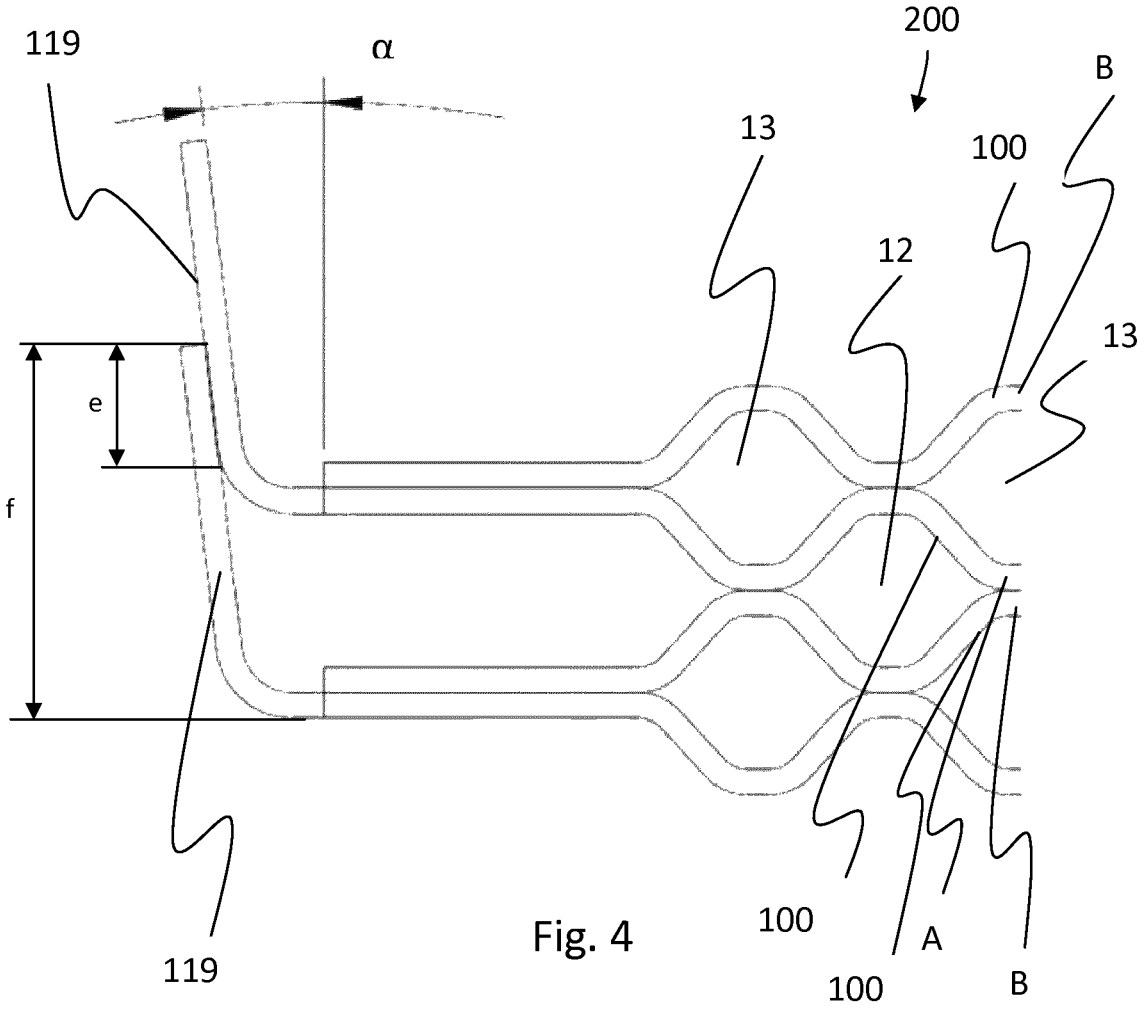
FIG. 4 discloses a cross section of the plate package across a lower flange.

Now turning to FIGS. 4 and 5, two schematic cross sections of a plate package 200 which is composed of a plurality of heat exchanger plates 100 of the above type is disclosed. The cross section in FIG. 4 is taken transverse the lower flange 119. For the record, a corresponding cross section taken transverse the upper flange 122 may look the same. The cross section in FIG. 5 is taken transverse the draining channel flange 109. In FIG. 5 also the wall 3 of the shell 1 of a heat exchanger device 300 is shown.

As given above, the heat exchanger plate 100 according to the invention can easily be converted into either a heat exchanger plate 100 of a first type A or into a heat exchanger plate 100 of a second type B by simply cutting off the lower and upper flanges 110, 122 and the draining channel flanges 109 after pressing.

When stacking the heat exchanger plates 100 to a form a plate package 200, one on top of the other, every second heat exchanger plate 100 is turned in the manner disclosed in FIG. 3, whereas every other heat exchanger plate 100 is rotated 180 degrees about a substantially vertical rotary axes coinciding with the sectional plane p. Thereby the corrugated pattern 106 of adjacent plates 11 will cross each other. Also, a plurality of contact points will be formed where the ridges 110 of the adjacent heat exchanger plates 100 abut each other. A layer of bonding material (not disclosed) may be arranged between the heat exchanger plates 100 during stacking. As the stack later is subjected to heat in an oven, the heat exchanger plates 100 will bond to each other along the contact points and thereby form a complex pattern of fluid channels. It is to be understood that the width of the joint depends of the cross section of the corrugations.

As is seen in the embodiments of FIGS. 4 and 5, the flanges of every second heat exchanger plate 100, i.e. the heat exchanger plate 100 of the second type B have been cut off. Also, the flanges 119, 122, 109 of the respective heat exchanger plates 100 of the first type are oriented in one and the same direction, and have an extension with a component along a normal to the main extension plane q such that a flange 119, 122, 109 of a heat exchanger plate 100 of the first type A abuts or overlaps a flange 119, 122, 109 of a second subsequent heat exchanger plate 100 of the first type A. The thus formed overlap between two subsequent flanges 119, 122, 109 has a length e as seen in a direction corresponding to the normal of the geometrical main extension plane q corresponding to 5-90% of the height f of the flange 119, 122, 109.

It is to be understood that it may be sufficient if the flange 119, 122, 109 of a heat exchanger plate 100 of the first type A abuts a flange 119, 122, 109 of a subsequent heat exchanger plate 100.

The flanges 119, 122, 109 are disclosed as having an extension along the lower portion 104 of the circumferential edge portion 101 and extending from the circumferential edge portion 101 at an angle α, β to the normal of the geometrical main extension plane q. The angle α, β is preferably smaller than 20 degrees to the normal and more preferred smaller than 15 degrees to the normal. The angle α, β depends on if both of two subsequent heat exchanger plates 100 of a plate pair to be joined are provided with flanges 119, 122, 109 or if only one of the heat exchanger plates 100 have a flange. In case of only one of the plates having a flange 119, 122, 109, the angle α, β can be made smaller, such as smaller than 10 degrees, such as smaller than 8 degrees and typically about 6-7 degrees. It is also to be understood that the angle α, β can be even 0 degrees. The angles α, β may be the same or be different from each other.

It is to be understood that the presence of the lower and upper flanges 119, 122 and also the draining channel flanges 109 contributes to guidance of the heat exchanger plates during stacking. Thereby fixtures can be made simpler.

Now turning to FIG. 6 one embodiment of the plate package 200 according to the invention is schematically disclosed as being contained in a heat exchanger device 300. From this view it can clearly be seen how the lower and upper flanges 119, 122 and also the two opposing draining channel flanges 109 form sealed circumferential side walls of the plate package 200. By the limited length of the lower and upper flanges 119, 122, the communication between the upper part space 2" of the shell 1 and the first plate interspace 12 is not influenced to any substantial effect.

Medium in liquid form that is present in the upper part space 2" of the shell 1 may be guided inside and along the plurality of draining channels 111 that extend along opposing side portions of the inner wall surface 3 of the shell 1 but at a distance therefrom, and also at a distance from the first plate interspaces 12 that are formed between opposing major surfaces of the heat exchanger plates 100. The distance is provided, depending on the design of the walls and the joints respectively defining the cross section of the draining channel 111 by at least the material thickness of the sheet material making up the heat exchanger plates 100. The distance formed can be seen as an insulation which reduces heat transfer from the inner wall surface 3 of the shell 1 and from the first plate interspaces 12 in the plate package 200 towards the draining channel 111 and which thereby reduces the risk of the liquid medium evaporating inside the draining channel 111 and thereby disturbance or stopping of the thermo-syphon loop. Thereby a more stable liquid flow is promoted.

Also, the draining channels 111 prevents compressor oil, which typically, due to its stronger affinity to carbon steel than stainless steel, is prone to follow the curvature of the inner wall surface 3 of the shell 1, from transferring into the first interspaces 12 of the plate package 200. By the presence of the draining channels 111, the compressor oil that is present inside the interspace between the inner wall surface 3 of the shell 1 and the outer boundary of the plate package 200 is prevented from transferring in a direction transverse the longitudinal extension of the draining channel 111 and into the first plate interspaces 12. Instead, the inflow of compressor oil into the first plate interspaces 12 is now restricted to longitudinal gaps 116 facing the upper part space 2" of the shell 1 and which forms openings towards to the first interspaces 12.

It is contemplated that there are numerous modifications of the embodiments described herein, which are still within the scope of the invention as defined by the appended claims.

By way of example, the heat exchanger plates 100 of the first and second types A; B may be identical with the only exception that the lower and upper flanges 119, 122 and the draining channel flanges 109 on every second heat exchanger plate 100 are cut-off to thereby convert them into heat exchanger plates 100 of the first and the second type A, B. Thereby, one and the same press tool may be used.

It is to be understood that also the heat exchanger plates 100 of the second type B may be provided with flanges 119, 122, 109 of the type described above and that these flanges are not cut-off. This allows for the flanges 119, 122, 109 of heat exchanger plates 100 of the first type A to sealingly abut flanges of heat exchanger plates A of the second type B.

The invention claimed is:

1. A heat exchanger plate for use in a plate package, the heat exchanger plate having a geometrical main extension plane (q) and a circumferential edge portion, the circumferential edge portion having a curved upper portion, a substantially straight lower portion and two opposing curved side portions interconnecting the upper and the lower portions, and an upper porthole arranged in an upper section of the heat exchanger plate and located at a distance from the upper portion of the circumferential edge portion thereby defining an upper intermediate portion located between the upper portion of the circumferential edge portion and a circumferential edge of the upper porthole, the upper intermediate portion including a shortest distance (d2) along a first line between a centre of the upper porthole and the upper portion of the circumferential edge portion, wherein a distance in a radial direction of the upper porthole between the upper portion of the circumferential edge portion and the circumferential edge of the upper porthole continuously increases on either side of the first line, wherein the heat exchanger plate, along at least a section of the upper intermediate portion, further comprises an upper flange having an extension along the upper portion of the circumferential edge portion and extending from the circumferential edge portion in a first direction from the geometrical main extension plane (q) and a draining channel flange extending in the first direction from each edge of the two opposing curved side portions, wherein ends of the upper flange are spaced from each of the draining channel flanges, and wherein the upper flange has a length (L2) as seen in a direction transverse the shortest distance (d2), being 200-80% of the diameter (D2) of the upper porthole.

2. The heat exchanger plate according to claim 1, further comprising a lower porthole spaced from the upper porthole in a height direction and arranged in a lower section of the heat exchanger plate and located at a distance from the lower portion of the circumferential edge portion thereby defining a lower intermediate portion located between the lower portion of the circumferential edge portion and a circumferential edge of the lower porthole, the lower intermediate portion including a shortest distance (d1) between a centre of the lower porthole and the lower portion of the circumferential edge portion, wherein the heat exchanger plate, along at least a section of the lower intermediate portion, further comprises a lower flange having an extension along the lower portion of the circumferential edge portion and extending from the circumferential edge portion in a direction from the geometrical main extension plane (q), and wherein the lower flange has a length (L1) transverse to the height direction smaller than a diameter (D1) of the lower porthole.

3. The heat exchanger plate according to claim 2, wherein the lower and/or upper flanges have an extension with a component along a normal to the main extension plane (q) of the heat exchanger plate, and wherein an angle (a) formed by the lower and/or upper flanges to the normal of the geometrical main extension plane (q) is smaller than 20 degrees to the normal.

4. A plate package for a heat exchanger device, the plate package comprising:

a plurality of heat exchanger plates of a first type (A); and a plurality of heat exchanger plates of a second type (B), wherein each of the plurality of heat exchanger plates of the first type (A) and the second type (B) is arranged alternatingly in the plate package, one on top of the other, and wherein at least the heat exchanger plates of the first type (A) correspond to the heat exchanger plate according to claim 1.

5. The plate package according to claim 4, wherein the heat exchanger plates of the first type (A) are identical with the heat exchanger plates of the second type (B); or wherein the heat exchanger plates of the first type (A) are identical with the heat exchanger plates of the second type (B), with the exception that the upper flanges are cut-off.

6. The plate package according to claim 4, wherein the flanges of the heat exchanger plates of the first type (A) are oriented in the first direction, and have an extension with a component along a normal to the main extension plane (q) such that a flange of a heat exchanger plate of the first type (A) abuts or overlaps a flange of a second subsequent heat exchanger plate of the first type (A).

7. The plate package according to claim 4, wherein the flanges of the heat exchanger plates are oriented in the first direction, and have an extension with a component along a normal to the main extension plane (q) such that a flange of a first heat exchanger plate of the first type (A) abuts or overlaps a flange of a subsequent heat exchanger plate, said subsequent heat exchanger plate being a heat exchanger plate of the second type (B).

8. The plate package according to claim 6, wherein the abutment or overlap between two subsequent flanges forms a sealed joint.

9. The plate package according to claim 4, wherein the alternatingly arranged heat exchanger plates form first plate interspaces which are substantially open and arranged to permit a flow of a medium to be evaporated there through, and second plate interspaces, which are closed and arranged to permit a flow of a fluid for evaporating the medium, wherein the heat exchanger plates of the first type (A) and of the second type (B) further comprise, along at least a section of the opposing side portions, mating abutment portions extending along and at a distance from the circumferential edge portion, thereby separating the respective first plate interspaces into an inner heat transferring portion (HTP) and two outer draining portions (DP), wherein at least the heat exchanger plates of the first type (A) further comprise, along at least a section of the opposing side portions, the draining channel flange extending from the circumferential edge portion in direction from the geometrical main extension plane (q), wherein the draining channel flanges of the respective heat exchanger plates are oriented in the first direction, and have an extension with a component along a normal to the main extension plane (q) such that a draining channel flange of a first heat exchanger plate of the first type (A) abuts or overlaps a draining channel flange of a subsequent heat exchanger plate, said subsequent heat exchanger plate being either a heat exchanger plate of the first type (A) or a heat exchanger plate of the second type (B), and wherein the draining channel flanges form outer walls to the outer draining portions (DP) thereby transforming the outer draining portions (DP) into draining channels.

10. A heat exchanger device, comprising:

a shell which forms a substantially closed inner space and which includes an inner wall surface facing the inner space; and a plate package comprising a plurality of heat exchanger plates according to claim 1.

11. The plate package according to claim 5, wherein the alternatingly arranged heat exchanger plates form first plate interspaces which are substantially open and arranged to permit a flow of a medium to be evaporated there through, and second plate interspaces, which are closed and arranged to permit a flow of a fluid for evaporating the medium, wherein the heat exchanger plates of the first type (A) and of the second type (B) further comprise, along at least a section of the opposing side portions, mating abutment portions extending along and at a distance from the circumferential edge portion, thereby separating the respective first plate interspaces into an inner heat transferring portion (HTP) and two outer draining portions (DP), wherein at least the heat exchanger plates of the first type (A) further comprise, along at least a section of the opposing side portions, the draining channel flange extending from the circumferential edge portion in direction from the geometrical main extension plane (q), wherein the draining channel flanges of the respective heat exchanger plates are oriented in the first direction, and have an extension with a component along a normal to the main extension plane (q) such that a draining channel flange of a first heat exchanger plate of the first type (A) abuts or overlaps a draining channel flange of a subsequent heat exchanger plate, said subsequent heat exchanger plate being either a heat exchanger plate of the first type (A) or a heat exchanger plate of the second type (B), and wherein the draining channel flanges form outer walls to the outer draining portions (DP) thereby transforming the outer draining portions (DP) into draining channels.

12. The plate package according to claim 6, wherein the alternatingly arranged heat exchanger plates form first plate interspaces which are substantially open and arranged to permit a flow of a medium to be evaporated there through, and second plate interspaces, which are closed and arranged to permit a flow of a fluid for evaporating the medium, wherein the heat exchanger plates of the first type (A) and of the second type (B) further comprise, along at least a section of the opposing side portions, mating abutment portions extending along and at a distance from the circumferential edge portion, thereby separating the respective first plate interspaces into an inner heat transferring portion (HTP) and two outer draining portions (DP), wherein at least the heat exchanger plates of the first type (A) further comprise, along at least a section of the opposing side portions, the draining channel flange extending from the circumferential edge portion in direction from the geometrical main extension plane (q), wherein the draining channel flanges of the respective heat exchanger plates are oriented in the first direction, and have an extension with a component along a normal to the main extension plane (q) such that a draining channel flange of a first heat exchanger plate of the first type (A) abuts or overlaps a draining channel flange of a subsequent heat exchanger plate, said subsequent heat exchanger plate being either a heat exchanger plate of the first type (A) or a heat exchanger plate of the second type (B), and wherein the draining channel flanges form outer walls to the outer draining portions (DP) thereby transforming the outer draining portions (DP) into draining channels.

13. The plate package according to claim 7, wherein the alternatingly arranged heat exchanger plates form first plate interspaces which are substantially open and arranged to permit a flow of a medium to be evaporated there through, and second plate interspaces, which are closed and arranged to permit a flow of a fluid for evaporating the medium, wherein the heat exchanger plates of the first type (A) and of the second type (B) further comprise, along at least a section of the opposing side portions, mating abutment portions extending along and at a distance from the circumferential edge portion, thereby separating the respective first plate interspaces into an inner heat transferring portion (HTP) and two outer draining portions (DP), wherein at least the heat exchanger plates of the first type (A) further comprise, along at least a section of the opposing side portions, the draining channel flange extending from the circumferential edge portion in direction from the geometrical main extension plane (q), wherein the draining channel flanges of the respective heat exchanger plates are oriented in the first direction, and have an extension with a component along a normal to the main extension plane (q) such that a draining channel flange of a first heat exchanger plate of the first type (A) abuts or overlaps a draining channel flange of a subsequent heat exchanger plate, said subsequent heat exchanger plate being either a heat exchanger plate of the first type (A) or a heat exchanger plate of the second type (B), and wherein the draining channel flanges form outer walls to the outer draining portions (DP) thereby transforming the outer draining portions (DP) into draining channels.

14. The plate package according to claim 1, wherein the substantially straight lower portion is directly below the upper porthole.

15. The plate package according to claim 14, further comprising a lower porthole directly below the upper porthole.

16. The heat exchanger plate according to claim 2, wherein the lower flange is straight.

17. The heat exchanger plate according to claim 1, further comprising a lower flange along the lower portion of the circumferential edge portion, the lower flange spaced from the upper flange in a height direction, wherein the lower flange is straight over an entire length in a width direction, the width direction being perpendicular to the height direction.

18. A heat exchanger plate for use in a plate package, the heat exchanger plate having a geometrical main extension plane (q) and a circumferential edge portion, the circumferential edge portion having a curved upper portion, a substantially straight lower portion and two opposing side portions interconnecting the upper and the lower portions, and an upper porthole arranged in an upper section of the heat exchanger plate and located at a distance from the upper portion of the circumferential edge portion thereby defining an upper intermediate portion located between the upper portion of the circumferential edge portion and a circumferential edge of the upper porthole, the upper intermediate portion including a shortest distance (d2) along a first line between a centre of the upper porthole and the upper portion of the circumferential edge portion, wherein a distance in a radial direction of the upper porthole between the upper portion of the circumferential edge portion and the circumferential edge of the upper porthole continuously increases on either side of the first line, wherein the heat exchanger plate, along at least a section of the upper intermediate portion, further comprises an upper flange having an extension along the upper portion of the circumferential edge portion and extending from the circumferential edge portion in a first direction from the geometrical main extension plane (q), and wherein the upper flange has a length (L2) as seen in a direction transverse the shortest distance (d2), being 200-80% of the diameter (D2) of the upper porthole;

a lower flange along the lower portion of the circumferential edge portion, the lower flange spaced from the upper flange in a height direction;

a lower porthole spaced from the upper porthole in the height direction and arranged in a lower section of the heat exchanger plate and located at a distance from the lower portion of the circumferential edge portion, wherein a length of the upper flange in a length direction transverse to the height direction is greater than the diameter of the upper porthole, and wherein a length of the lower flange in the length direction is less than a diameter of the lower porthole.

19. The heat exchanger plate according to claim 1, wherein the upper flange has a central section and two end sections, each of the end section extending at an angle from the central section.

20. A heat exchanger plate for use in a plate package, the heat exchanger plate having a geometrical main extension plane (q) and a circumferential edge portion, the circumferential edge portion having a curved upper portion, a substantially straight lower portion and two opposing curved side portions interconnecting the upper and the lower portions, and an upper porthole arranged in an upper section of the heat exchanger plate and located at a distance from the upper portion of the circumferential edge portion thereby defining an upper intermediate portion located between the upper portion of the circumferential edge portion and a circumferential edge of the upper porthole, the upper intermediate portion including a shortest distance (d2) along a first line between a centre of the upper porthole and the upper portion of the circumferential edge portion, wherein the heat exchanger plate, along at least a section of the upper intermediate portion, further comprises an upper flange having an extension along the upper portion of the circumferential edge portion and extending from the circumferential edge portion in a first direction from the geometrical main extension plane (q) and a draining channel flange extending in the first direction from each edge of the two opposing curved side portions, wherein ends of the upper flange are spaced from each of the draining channel flanges, and wherein the upper flange has a length (L2) as seen in a direction transverse the shortest distance (d2), being 200-80% of the diameter (D2) of the upper porthole.

* * * * *